US006920308B2

(12) United States Patent
Demchock et al.

(10) Patent No.: US 6,920,308 B2
(45) Date of Patent: Jul. 19, 2005

(54) METHOD AND APPARATUS FOR CONTROLLING THE VELOCITY OF COPY SUBSTRATES DURING REGISTRATION

(75) Inventors: Stephen A. Demchock, Rochester, NY (US); LeRoy A. Baldwin, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 33 days.

(21) Appl. No.: 10/679,571

(22) Filed: Oct. 6, 2003

(65) Prior Publication Data

US 2005/0074267 A1 Apr. 7, 2005

(51) Int. Cl.[7] ..... G03G 15/00
(52) U.S. Cl. ..... 399/396; 399/395
(58) Field of Search ..... 399/396, 395, 399/388, 394

(56) References Cited

U.S. PATENT DOCUMENTS 4,473,222 A 9/1984 Simmons et al.
4,984,778 A 1/1991 Alexander et al.
5,094,442 A 3/1992 Kamprath et al.
5,119,135 A 6/1992 Baldwin
5,596,399 A 1/1997 Dempsey et al.
5,848,344 A 12/1998 Milillo et al.
6,014,542 A * 1/2000 Hozumi et al. ..... 399/394
6,373,042 B1 4/2002 Kretschmann et al.
6,529,703 B2 * 3/2003 Kawasumi et al. ..... 399/388
6,771,928 B2 * 8/2004 Fujita ..... 399/394

* cited by examiner

*Primary Examiner*—Quana Grainger
(74) *Attorney, Agent, or Firm*—Fay, Sharpe, Fagan, Minnich & McKee, LLP

(57) ABSTRACT

A method of controlling the velocity of a copy substrate in an electrophotographic reproduction machine which includes a substrate registration system for transporting and registering the substrate and a toner image traveling to a toner image transfer point at a transfer velocity. The method includes decelerating the substrate from a process velocity to a low velocity, where the transfer velocity is greater than the low velocity and less than the process velocity, registering the substrate via the substrate registration system, and accelerating the substrate to the transfer velocity for image transfer.

20 Claims, 6 Drawing Sheets

METHOD AND APPARATUS FOR CONTROLLING THE VELOCITY OF COPY SUBSTRATES DURING REGISTRATION

BACKGROUND

The exemplary embodiment relates generally to electrophotographic reproduction machines and, more particularly, concerns a method and apparatus for controlling the velocity of copy substrates during substrate registration in an electrophotographic reproduction machine, such as a printer or copier.

In high-speed reproduction machines, such as electrophotographic copiers and printers, a photoconductive member (or photoreceptor) is charged to a uniform potential and then a light image of an original document is exposed onto a photoconductive surface, either directly or via a digital image driven laser. Exposing the charged photoreceptor to a light image discharges the photoconductive surface thereof in areas corresponding to non-image areas in the original document while maintaining the charge on the image areas to create an electrostatic latent image of the original document on the photoconductive surface of the photoreceptor. A developer material is then brought into contact with the surface of the photoconductive member to transform the latent image into a visible reproduction. The developer material includes toner particles with an electrical polarity opposite that of the photoconductive member, causing them to be naturally drawn to it. A blank copy substrate such as a sheet of paper is brought into contact with the photoconductive member and the toner materials are transferred to it by electrostatic charging of the substrate. The substrate is subsequently heated for permanent bonding of the reproduced image, thus producing a hard copy reproduction of the original document or image. Thereafter, the photoconductive member is cleaned and reused for subsequent copy production.

Various sizes of copy substrates are typically stored in trays that are mounted at the side of the machine. In order to duplicate a document, a copy substrate with the appropriate dimensions is transported from the appropriate tray into the paper path just ahead of the photoreceptor. The substrate is then brought into contact with the toner image on the surface of the photoconductive member prior to transfer. However, a registration mechanism typically intercepts the substrate in advance of the photoconductive member and either stops it or slows it down in order to synchronize the substrate with the image on the photoconductive member. The registration mechanism also effects proper process direction (or longitudinal) alignment of the copy substrate prior to delivery to the photoconductive member by correcting skew in the substrate. The registration mechanism also effects proper cross-process direction (or lateral) alignment of the copy substrate prior to delivery to the photoconductive member by correcting lateral offset in the substrate.

One way to perform substrate registration is with a translational electronic registration (or TELER) system. A TELER system typically includes optical sensors, coaxial independently driven drive rollers (or nips), a carriage with a linear drive on which the independently driven paper drive rollers are mounted, and a microprocessor controller. In operation, a substrate is driven into the nips and moved through the paper path for placement and fusing of an image onto the substrate. The speed of both nips can be controlled to effect skew alignment and longitudinal registration. The nips are mounted on the carriage movable transversely with respect to the feed path. An optical sensor system controls positioning of the carriage to achieve the desired top edge or a lateral positioning of the substrate. Independent control of the nips and carriage translation provides simultaneous alignment in longitudinal and lateral directions.

Generally, in TELER-based systems and as shown in FIG. 1, the copy substrate travels to the registration nips at a given process velocity $v_p$ for the time period $t_{proc}-t_{decel}$. It is decelerated at time $t_{decel}$ to a given transfer velocity $v_t$ to complete registration and synchronize with the photoconductive member, which is also traveling at the transfer velocity $V_t$. This known velocity profile allows the image-to-substrate transfer to occur without smearing. However, due to recent developments in high-speed electrophotographic reproduction machines, the paper path must be able to transport and register ever smaller substrates, such as those less than letter (8½ by 11 inch) size, at increasingly faster speeds. In order to handle the smaller substrates and faster speeds, it has been found to be necessary to move the registration nips closer to the image transfer area. However, using the standard velocity profile as shown in FIG. 1, whereby the substrate is decelerated directly from the process velocity to the transfer velocity over the reduced nip-to-transfer distance, results in undesirable cross-process direction latitude. This is due primarily to the lack of time available to complete registration of the substrate.

Accordingly, there is a need for a method and apparatus for controlling the velocity of copy substrates during registration and allowing sufficient time for completing registration.

SUMMARY

In accordance with one aspect of the exemplary embodiment, there is provided a method of controlling the velocity of copy substrates in an electrophotographic reproduction machine having a substrate registration system for transporting and registering the substrate and a toner image traveling to a toner image transfer point at a transfer velocity. The method includes decelerating the substrate from a process velocity to a low velocity, where the transfer velocity is greater than the low velocity and less than the process velocity, registering the substrate via the substrate registration system, and accelerating the substrate to the transfer velocity for image transfer.

In accordance with another aspect of the exemplary embodiment, there is provided an apparatus for controlling the velocity of a copy substrate. The apparatus includes a photoreceptor for transferring a toner image to an image transfer station at a transfer velocity, a substrate registration system, which includes a registration transport with pre-registration drive rollers for driving the substrate and a registration assembly for registering the substrate, a substrate feeder module for feeding the substrate to the registration transport of the substrate registration system at a process velocity, which is faster than the transfer velocity; and registration drive rollers for decelerating the substrate to a low velocity, which is slower than the transfer velocity.

BRIEF DESCRIPTION OF THE DRAWINGS

The foregoing and other features of the exemplary embodiment will be apparent and easily understood from a further reading of the specification, claims, and by reference to the accompanying drawings in which:

DETAILED DESCRIPTION OF THE EXEMPLARY EMBODIMENT

The present application is directed to a method and apparatus for controlling the velocity of a substrate, such as a copy sheet, during registration (or alignment) in an electrophotographic reproduction machine, such as a copier or a printer. The number of copy sheets printed per minute can also be enhanced.

Figure 1:
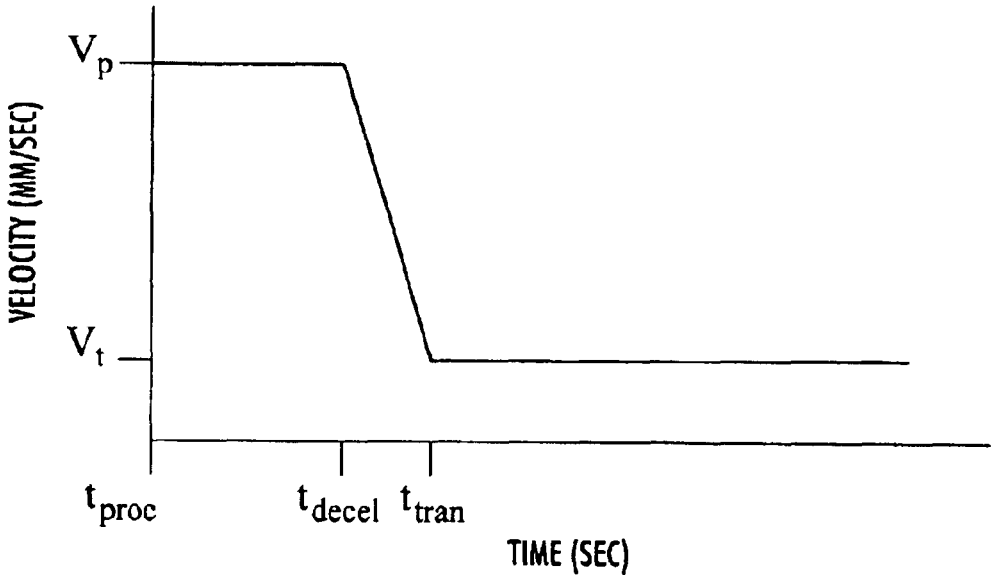
FIG. 1 (PRIOR ART)
FIG. 1 shows a known velocity profile for a copy substrate during registration.
Figure 2:
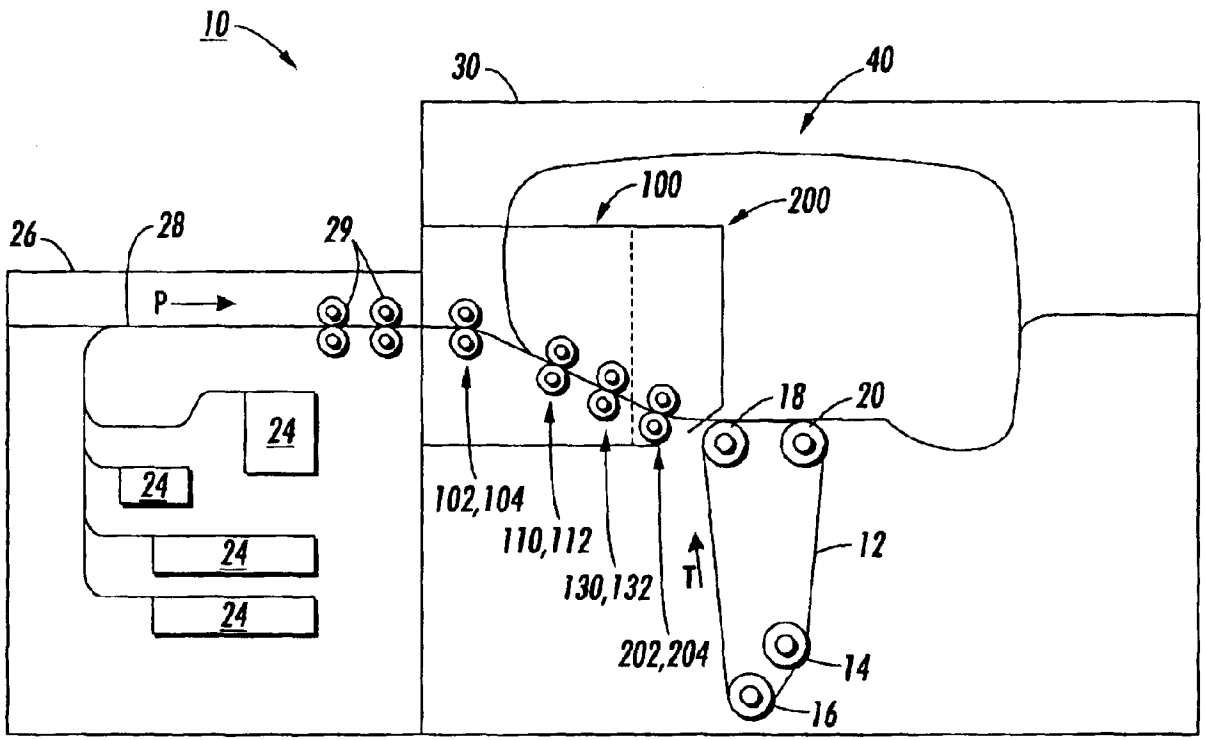
FIG. 2 is a diagrammatic view of an electrophotographic reproduction machine incorporating a substrate registration mechanism according to the exemplary embodiment.

Referring now to the drawings where the showings are for the purpose of describing exemplary embodiment and not for limiting the same, FIG. 2 is a schematic depiction of the various components of an electrophotographic copying machine 10. Preferably, the machine 10 may employ a belt 12 having a photoconductive surface deposited on an electrically grounded conductive surface. The machine 10 may include at least a pair of rollers 14, 16 relating to the belt 12. The machine 10 further includes a duplex path 40 for making double-sided copies.

The operation begins by scanning an original document, whereby the document is exposed to a light source (not shown). This causes the image to be reflected back toward the machine 10 and onto the belt 12, creating a latent image on the belt 12. Once the latent image is generated, the belt 12 will move the latent image in the transfer direction T. Toner particles are deposited onto it at the development station (not shown), thereby transforming the latent image into a developed image. The belt 12 and the developed image will then proceed toward a photoreceptor contact point 18 and finally to an image transfer station 20.

However, before the developed image reaches the transfer station 20, a blank copy substrate, such as a sheet of copy paper, will be removed from one of paper trays 24 in a substrate feeder module 26 and transported along paper path 28 in the indicated process direction P. The copy substrate will pass through a substrate registration system 30 at the end of the paper path 28 to be placed in contact with the developed image just as it reaches the photoreceptor contact station 18. The copy substrate with the developed image now on it will then move to the image transfer station 20 where the toner image will be permanently affixed to the copy substrate.

The foregoing description should be sufficient for purposes of illustrating the general operation of an electrophotographic copying machine incorporating an exemplary embodiment. As described, an electrophotographic copying machine may take the form of any of several well known devices or systems. Variations of specific electrophotographic processing subsystems or processes may be expected without affecting the operation of the exemplary embodiment.

Figure 3:
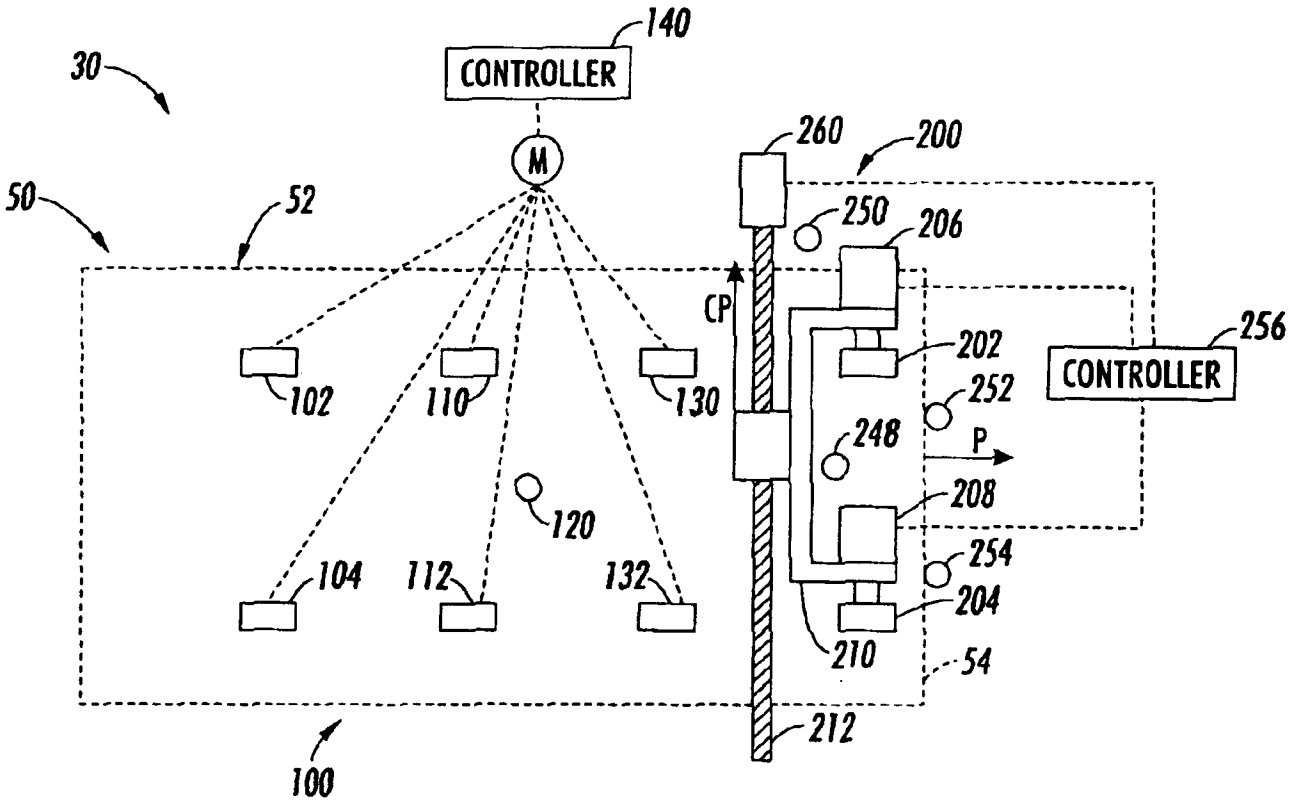
FIG. 3 is a more detailed diagrammatic representation in plan view of a substrate registration mechanism according to the exemplary embodiment.

Referring now to FIG. 3, the registration system 30 is shown in more detail in schematic form. In particular, the registration system includes a registration transport 100 and a registration assembly 200, such as a translating electronic registration (TELER) assembly. The registration transport 100 includes a first pair of simplex drive rollers (or SIM 1 nips) 102, 104, a second pair of simplex drive rollers (or SIM 2 nips) 110, 112, an arrival sensor 120, and a pair of preregistration drive rollers (or pre-reg nips) 130 and 132. The SIM 1 nips 102, 104, the SIM 2 nips 110, 112, and the pre-reg nips 130, 132 are driven by at least one motor M, which is, in turn, controlled by a microprocessor controller 140. In the exemplary embodiment, the motor M is a three phase brushless direct current motor. However, other types of motors may be used, such as a stepper motor, as well as other combinations of motors.

An exemplary TELER assembly 200 is illustrated in more detail in FIG. 3. In the embodiment shown, the TELER assembly 200 includes a carriage 210 and a lead screw 212. The TELER assembly 200 also has inboard drive rollers (or IB nip) 202 and outboard drive rollers (or OB nip) 204, which are mounted thereon in rotatable fashion and are driven by inboard drive motor 206 and outboard drive motor 208, respectively. (Outboard generally refers to a position closer to the operator of the machine 10, whereas inboard generally refers to a position away from the operator.) In the exemplary embodiment, motors 206 and 208 are stepper motors. However, any other known motors may be used, including, but not limited to, three phase, brushless, direct current motors. In addition, motors 206 and 208 generally rotate each drive roll pair at variable rates of speed.

Generally, the IB and OB nips 202, 204 engage the copy substrate 50 and drive it through the registration mechanism 200. The registration assembly 200 typically includes a set of optical sensors, such as a nip release sensor 248, a top edge sensor 250, an inboard skew sensor 252, and an outboard skew sensor 254. These optical sensors may be used to detect the presence of the top edge 52 and the lead edge 54 of the copy substrate 50. More specifically, the nip release sensor 248 is generally disposed between and upstream of the IB and OB nips 202, 204 for determining when to release the pre-reg nips 130, 132 (and for longer papers the SIM 2 nips 110 and 112 and the SIM 1 nips 102 and 104). The top edge sensor 250 is disposed upstream of nips 202 and 204 for top edge detection of the copy substrate 50 and for control of a carriage motor 260. (The top edge sensor is movable, laterally, and positioned where substrate registration is desired, based on the size of the substrate). The skew sensors 252 and 254 are disposed downstream of the registration nips 202, 204 for determining the skew of the copy substrate 50. The sequence of engagement of the skew sensors 252, 254 and the amount of time between each detection is utilized to generate control signals for correcting skew (rotational misalignment of the copy substrate about an axis perpendicular to the process direction P) of the copy substrate 50 by variation in the speed of registration nips 202, 204. The top edge sensor 250 is arranged to detect the top edge 52 of the copy substrate 50, and the output is used to control carriage motor 260.

Figure 4:
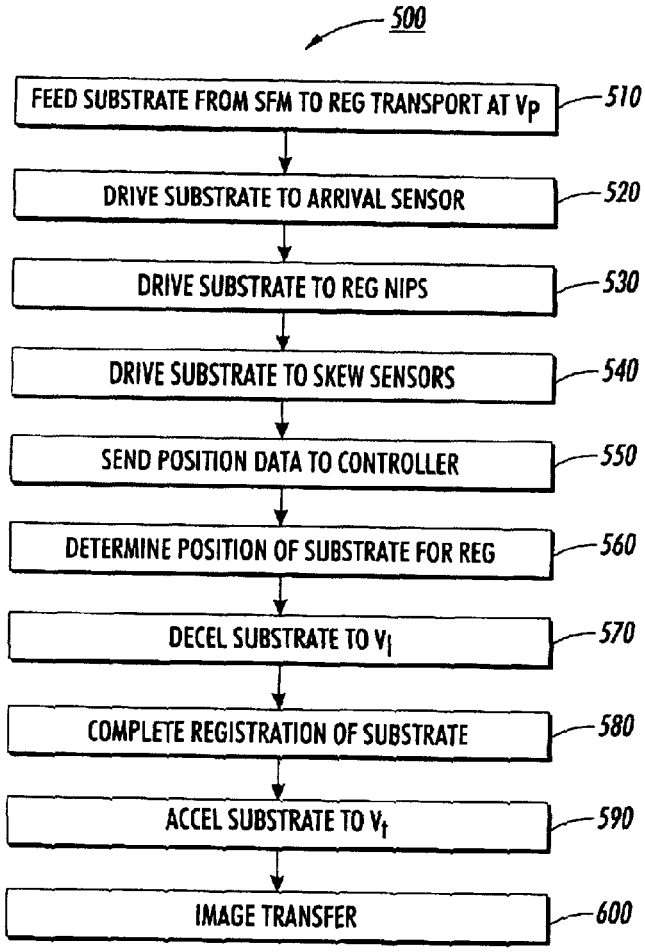
FIG. 4 is a flow chart illustrating a method for controlling the velocity of a substrate during registration according to the exemplary embodiment.

FIG. 4 illustrates an exemplary embodiment of a substrate velocity control method 500. The method 500 includes feeding the copy substrate 50 from the substrate feeder module 26 to the registration transport 100 at a given process velocity $v_p$ (510). The substrate 50 travels along the paper path 28 in the process direction P. The method further includes driving the substrate 50 through the registration transport 100 via the SIM 1 nips 102, 104 and the SIM 2 nips 110, 112, whereupon the lead edge 54 subsequently reaches the arrival sensor 120 (520). The substrate feeder module 26 feeds the substrate 50 so that it nominally arrives at the registration nips 202, 204 of the registration assembly 200 at an expected time, which is based upon its process velocity $v_p$ and the distance it has to travel from the substrate feeder module 26. Thus, the substrate 50 can arrive from the substrate feeder module 26 earlier than it was expected, at its nominal arrival time, or later than it was expected. However, there are upper and lower limits to the arrival time. That is, if the substrate 50 arrives too late, there will not be enough time for registration, and the next substrate upstream will run into it. Likewise, if the substrate 50 is too early, it may run into the substrate downstream. The controller 140 maintains a constant speed of all the nips upstream of the registration nips. Meanwhile, the pre-reg nips 130, 132 drive the substrate 50 through the registration transport 100, past the sensors 248, 250 and to the registration nips 202, 204 of the registration assembly 200 (530). Then, the registration nips 202, 204 drive the substrate to the skew sensors 252, 254 (540). The registration sensors 248, 250, 252, 254 communicate information concerning the position of the substrate 50 to a controller 256 for controlling registration of the substrate 50 (550, 560). The registration nips 202, 204 then decelerate the substrate 50 to a low velocity $v_l$ at a time $t_{decel}$ (570). Incoming skew is corrected during deceleration. The time that the substrate stays at low velocity is based upon whether the substrate 50 arrived early, at its nominal time, or late. Further, the carriage motor 260 drives the carriage 210 in the appropriate cross-process direction (CP) for cross-process direction correction (580). The registration nips 202, 204 then accelerate the substrate 50 to the transfer velocity $v_t$ of the belt 12 at a time $t_{accel}$ so that image transfer can take place (590, 600).

Figure 5A:
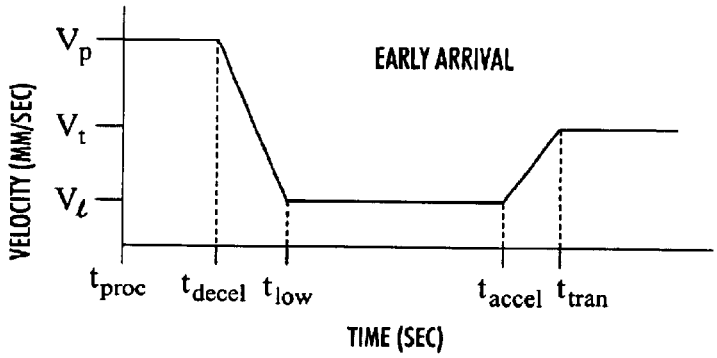
FIGS. 5A–C illustrate several examples of a velocity profile during registration for a copy substrate according to the exemplary embodiment.
Figure 5B:
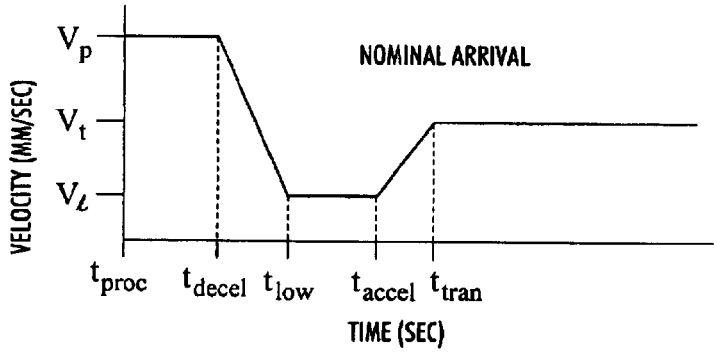
Figure 5C:
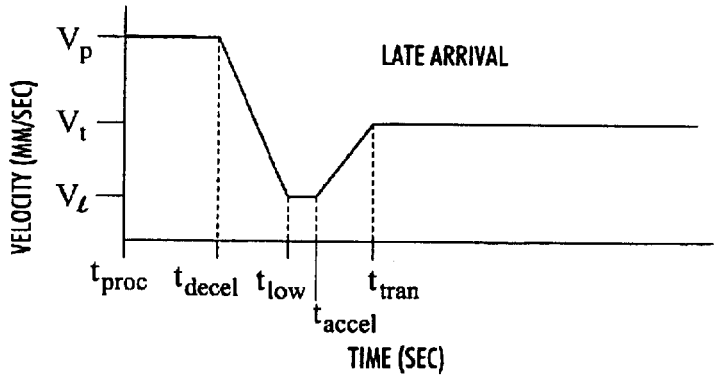

FIGS. 5A–C illustrate the exemplary velocity profiles for a substrate based upon early, nominal, and late arrival, respectively. From point $t_{proc}$ to point $t_{decel}$, the substrate 50 is traveling at the process velocity $v_p$. By the time $t_{decel}$, the skew sensors 252, 254, have first detected the leading edge of the substrate 50. The controller 256 begins decreasing the speed of the substrate 50 via the registration nips 202, 204 during the period $t_{decel}$–$t_{low}$ to the low velocity $v_l$. Thereafter, the substrate 50 travels at the low velocity $v_t$ via the registration nips 202, 204 during the period of time $t_{low}$–$t_{accel}$. By the time $t_{accel}$, cross-process direction registration, process direction registration and skew correction are complete. However, it should be noted that there are cases where cross-process direction registration may not be completed yet. The controller 256 begins increasing the speed of the substrate 50 via the registration nips 202, 204 during the period $t_{accel}$–$t_{tran}$ to the transfer velocity $v_t$. The period of time $t_{low}$–$t_{accel}$ that the substrate 50 remains at the low velocity $v_l$ varies. Thus, the substrate 50 will remain at the low velocity $v_l$ for the longest period of time when it arrives early. Likewise, the substrate 50 will remain at the low velocity $v_l$ for the shortest period of time when the substrate 50 arrives late. Nonetheless, even when the substrate 50 arrives late, there is sufficient time to complete registration and skew correction and return the carriage to its original position.

The velocity profiles for the substrate 50 are based upon routine calculations taking into account such parameters as the distance between sensors, the distance between drive rollers (or nips), the diameter of the drive rollers, and the desired copy rate. Such computations and implementation are made via the microprocessor controller 256. The velocities $v_p$, v, and $v_t$ can be any suitable speeds which allow for sufficient time for completing substrate registration and skew correction, as well as to returning the carriage 212 to its original position, before the next substrate reaches the registration nips 202, 204.

In the exemplary embodiment, the process velocity $v_p$ is set at about 1020 millimeters per second, the low velocity $v_l$ is set at about 220 millimeters per second, and the transfer velocity $v_t$ is set at about 596 millimeters per second. With such a velocity profile, it may be possible to achieve about 120 copies per minute for letter size (8½×11 inch) paper and about 72 copies per minute for 11×17 inch paper with machine 10.

In the alternative, it may be desirable to achieve a higher copy rate with machine 10, such as about 180 copies per minute for letter size paper. Thus, in an alternative embodiment, the velocity profile of the substrate 50 is slightly different. That is, the process velocity $v_p$ is set at about 1530 millimeters per second, the low velocity $v_l$ is set at about 450 millimeters per second, and the transfer velocity $v_t$ is set at about 894 millimeters per second. These alternative settings will also provide sufficient time to complete registration and skew correction and return the carriage 212 to its original position, regardless of whether the substrate 50 arrives early, at its nominal time, or late to the registration transport 100.

Figure 4A:
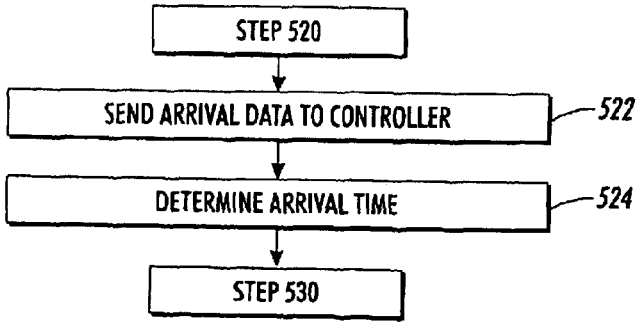
FIG. 4A illustrates an alternative embodiment of the method of FIG.

In order to implement the velocities of the alternative embodiment, certain structural modifications to the registration transport 100 may be in order. That is, it may be necessary to drive the SIM 1 nips 102, 104, the SIM 2 nips 110, 112 and the pre-reg nips 130, 132 with an additional motor M, such as a stepper motor. Stepper motors are known to provide affordable and accurate positioning and speed control and may be particularly useful with such high-speed electrophotographic copying. Accordingly, the substrate velocity control method 500 of FIG. 4 may include some additional steps, as shown in FIG. 4A. That is, after the substrate 50 is driven to the arrival sensor 120, the sensor 120 sends data concerning the arrival time to the controller 140 (522). Then, the controller 140 uses this data to automatically determine whether the substrate 50 has arrived early, at its nominal time, or late, in order to maintain repeatable arrival times at the TELER assembly 200.

Figure 6A:
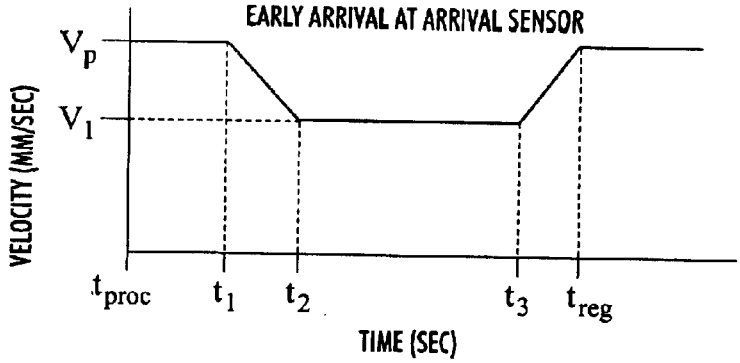
FIGS. 6A–C illustrate several examples of a velocity profile before registration for a copy substrate according to an alternative embodiment.
Figure 6B:
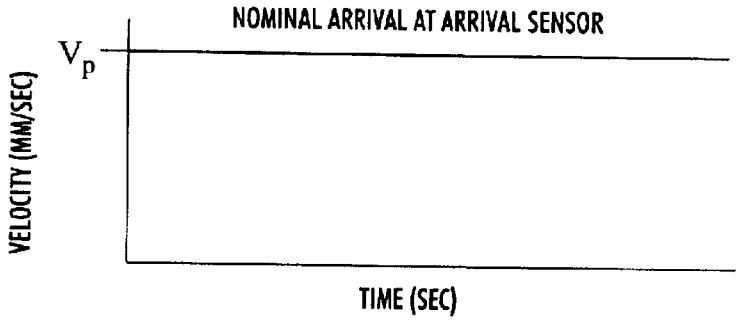
Figure 6C:
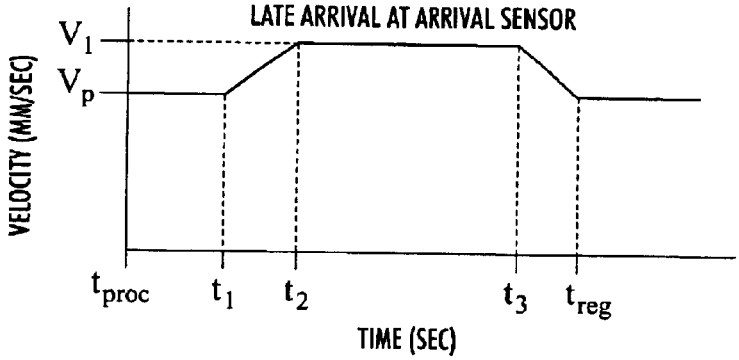

FIGS. 6A–C illustrate alternative velocity profiles for a substrate before it reaches the TELER 200, based upon early, nominal, and late arrival, respectively. From point $t_{proc}$ to point$_{t1}$, the substrate 50 is traveling at the process velocity $v_p$. The controller 140 begins decreasing or increasing the speed of the substrate 50 during the period $t_1$–$t_2$ to the velocity $v_1$. Thereafter, the substrate 50 travels at the lower or higher velocity during the period of time $t_2$–$t_3$. At the time $t_3$, the controller 140 begins increasing or decreasing the speed of the substrate 50 during the period $t_3$–$t_{reg}$ to the process velocity $v_p$. The period of time $t_2$–$t_3$ that the substrate 50 remains at the lower or higher velocity $v_l$ varies. Thus, the substrate 50 will remain at the low velocity $v_l$ for a period of time when it arrives early. Likewise, the substrate 50 will remain at a high velocity $v_l$ for a period of time when the substrate 50 arrives late.

Also, to prevent excessive drag on the substrates or buckling when running longer substrates, nip release mechanisms may need to be added to the last two drive rollers 29 of the substrate feeder module 26. An alternative would be to add one-way clutches to the last two drive rollers 29 of the substrate feeder module 26 and have substrates delivered to the registration transport 100 late so that they always have to be accelerated. These approaches will control the substrate arrival time at the registration nips allowing the timing strategy to work, with latitude.

While particular embodiments have been described, alternatives, modification, variations, improvements and substantial equivalents that are or may be presently unforeseen may arise to applicants or others skilled in the art. Accordingly, the appended claims as filed and as they may be amended are intended to embrace all such alternatives, modifications, variations, improvements, and substantial equivalents.

What is claimed is:

1. In an electrophotographic reproduction machine having a substrate registration system for transporting and registering the substrate and a toner image traveling at a transfer velocity, a method of controlling the velocity of a copy substrates comprising:

decelerating the substrate from a process velocity to a low velocity, wherein the transfer velocity is greater than the low velocity and less than the process velocity;

performing registration of the substrate via the translational electronic registration system, wherein the substrate registration system comprises a translational electronic registration system and registration includes at least one of skew correction, process direction correction, and cross-process direction correction; and accelerating the substrate to the transfer velocity for image transfer.

2. In an electrophotographic reproduction machine having a substrate registration system for transporting and registering the substrate and a toner image traveling at a transfer velocity, a method of controlling the velocity of a copy substrates comprising:

feeding the substrate from a substrate feeder module to the substrate registration system;

sensing the arrival time of the substrate at the substrate registration system;

sensing the position of the substrate in the substrate registration system;

decelerating the substrate from a process velocity to a low velocity, wherein the transfer velocity is greater than the low velocity and less than the process velocity;

registering the substrate via the substrate registration system; and accelerating the substrate to the transfer velocity for image transfer.

3. The method of claim 2 wherein:

the process velocity is about 1020 millimeters/second;

the low velocity is about 220 millimeters/second; and the transfer velocity is about 596 millimeters/second.

4. The method of claim 2 wherein:

the process velocity is about 1530 millimeters/second;

the low velocity is about 450 millimeters/second; and the transfer velocity is about 894 millimeters/second.

5. The method of claim 2 further comprising transporting the substrate through the registration system via a first pair of simplex drive rollers, a second pair of simplex drive rollers, and a pair of pre-registration drive rollers.

6. The method of claim 5 wherein the transporting step further includes driving the drive rollers with a three phase, brushless, direct current motor.

7. The method of claim 5 wherein the transporting step further includes:

driving the first pair of simplex drive rollers with a three phase, brushless, direct current motor; and driving the second pair of simplex drive rollers and the pair of pre-registration drive rollers with a stepper motor.

8. The method of claim 2 further comprising:

sending arrival data to a controller; and determining whether the substrate has arrived early, at a nominal time, or late, in order to maintain repeatable arrival times at the substrate registration system.

9. An apparatus for controlling the velocity of a copy substrate in an electrophotographic reproduction machine having a substrate registration system for transporting and registering the substrate and a toner image traveling at a transfer velocity, the apparatus comprising:

decelerating means for decelerating the substrate from a process velocity to a low velocity, wherein the transfer velocity is greater than the low velocity and less than the transfer process velocity;

a translational electronic registration system for registering the substrate, wherein the registration of the substrate includes at least one of skew correction, process direction correction, and cross-process direction correction; and accelerating means for accelerating the substrate to the transfer velocity for image transfer.

10. An apparatus for controlling the velocity of a copy substrate in an electrophotographic reproduction machine having a substrate registration system for transporting and registering the substrate and a toner image traveling at a transfer velocity, the apparatus comprising:

feeding means for feeding the substrate from a substrate feeder module to the substrate registration system;

arrival sensing means for sensing the arrival time of the substrate from the substrate feeder module to the substrate registration system;

position sensing means for sensing the position of the substrate in the substrate registration system;

decelerating means for decelerating the substrate from a process velocity to a low velocity, wherein the transfer velocity is greater than the low velocity and less than the transfer process velocity;

registering means for registering the substrate; and accelerating means for accelerating the substrate to the transfer velocity for image transfer.

11. The apparatus of claim 10 wherein:

the process velocity is about 1020 millimeters/second;

the low velocity is about 220 millimeters/second; and said transfer velocity is about 596 millimeters/second.

12. The apparatus of claim 10 wherein:

the process velocity is about 1530 millimeters/second;

the low velocity is 450 millimeters/second; and the transfer velocity is about 894 millimeters/second.

13. The apparatus of claim 10 wherein the registration system includes a first pair of simplex drive rollers, a second pair of simplex drive rollers, and a pair of pre-registration drive rollers for transporting the substrate through the registration system.

14. The apparatus of claim 13 wherein the registration system further includes a three phase brushless direct current motor for driving the drive rollers.

15. The apparatus of claim 13 wherein the registration system further includes a three phase brushless direct current motor for driving the first pair of simplex drive rollers and a stepper motor for driving the pair of simplex drive rollers and the pair of pre-registration drive rollers.

16. An apparatus for controlling the velocity of a copy substrate comprising:

a photoreceptor for transferring a toner image to an image transfer station at a transfer velocity;

decelerating means for decelerating the substrate from a process velocity to a low velocity, wherein the transfer velocity is greater than the low velocity and less than the transfer process velocity;

accelerating means for accelerating the substrate to the transfer velocity for image transfer;

a substrate registration system, the registration system including a registration transport for driving the substrate and a registration assembly for registering the substrate;

a substrate feeder module for feeding the substrate to the registration transport of the substrate registration system at a process velocity, the process velocity being faster than the transfer velocity; and a plurality of registration drive rollers for decelerating the substrate to a low velocity, the low velocity being slower than the transfer velocity.

17. The apparatus of claim 16 wherein:

the process velocity is about 1020 millimeters/second;

the low velocity is about 220 millimeters/second; and said transfer velocity is about 596 millimeters/second.

18. The apparatus of claim 16 wherein:

the process velocity is about 1530 millimeters/second;

the low velocity is about 450 millimeters/second;

the transfer velocity is about 894 millimeters/second.

19. The apparatus of claim 16 wherein the registration transport includes a first pair of simplex drive rollers, a second pair of simplex drive rollers, an arrival sensor, a pair of pre-registration drive rollers, and a motor for driving the drive rollers.

20. The apparatus of claim 19 wherein the registration transport further includes a stepper motor for driving the drive rollers, and a plurality of nip release mechanisms for preventing excessive drag on the substrate.

* * * * *